US010508890B2

(12) United States Patent
Shurman et al.

(10) Patent No.: US 10,508,890 B2
(45) **Date of Patent: *Dec. 17, 2019**

(54) SYSTEM, METHOD AND APPARATUS FOR TOYS AND GAMES FOR WATER GUNS

(71) Applicants: Anthony C. Shurman, Westfield, NJ (US); Jennifer L. Shurman, Westfield, NJ (US); Jackson C. Shurman, Westfield, NJ (US); Maxwell A. Shurman, Westfield, NJ (US)

(72) Inventors: Anthony C. Shurman, Westfield, NJ (US); Jennifer L. Shurman, Westfield, NJ (US); Jackson C. Shurman, Westfield, NJ (US); Maxwell A. Shurman, Westfield, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/263,722

(22) Filed: Jan. 31, 2019

(65) Prior Publication Data

US 2019/0162511 A1 May 30, 2019

Related U.S. Application Data

(63) Continuation of application No. 15/139,922, filed on Apr. 27, 2016, now Pat. No. 10,228,221.

(60) Provisional application No. 62/266,591, filed on Dec. 12, 2015, provisional application No. 62/212,050, filed on Aug. 31, 2015.

(51) Int. Cl.

| | |
|---|---|
| ***A63F 9/02*** | (2006.01) |
| ***F41J 5/24*** | (2006.01) |
| *F41B 9/00* | (2006.01) |

(52) U.S. Cl.
CPC . *F41J 5/24* (2013.01); *A63F 9/02* (2013.01); *A63F 2250/0428* (2013.01); *F41B 9/00* (2013.01)

(58) Field of Classification Search
CPC ..... A63F 2250/0428; A41D 27/08; F41J 5/24
USPC ..... 273/349, 350, 378, 380; 2/244
See application file for complete search history.

(56) References Cited

U.S. PATENT DOCUMENTS

| | | | | | |
|---|---|---|---|---|---|
| 4,743,030 | A * | 5/1988 | Auer | A63F 3/0685 | 222/79 |
| 5,411,269 | A * | 5/1995 | Thomas | A63F 9/02 | 273/349 |
| 5,626,343 | A * | 5/1997 | Sanders | A63F 9/0243 | 273/349 |
| 5,682,648 | A * | 11/1997 | Miller | A45F 5/08 | 24/303 |
| 5,826,879 | A * | 10/1998 | Spector | F41J 5/24 | 273/349 |
| 5,893,562 | A * | 4/1999 | Spector | A63F 9/0243 | 273/349 |

(Continued)

*Primary Examiner* — Mark S Graham

(57) ABSTRACT

A toy may include a target having a target magnet and a first color configured to become a second color when the target is activated. The toy also may include a backing having a backing magnet configured to be mounted to an interior of a garment. The backing may be magnetically attracted to the target magnet through the garment when the target is on an exterior of the garment. The target may be configured to be retained on the garment only via magnetic force between the target magnet and the backing magnet. The target and the backing may be configured to be readily removed from the garment and have numerous re-uses for future play.

20 Claims, 2 Drawing Sheets

(56) References Cited

U.S. PATENT DOCUMENTS

| | | | | |
|---|---|---|---|---|
| 5,996,116 | A * | 12/1999 | Tate | A01K 97/06 2/12 |
| 6,966,557 | B2 * | 11/2005 | Kirk | A63F 9/0243 273/349 |
| 7,808,392 | B1 * | 10/2010 | Anklesaria | A61F 13/42 200/61.04 |
| 8,678,877 | B2 * | 3/2014 | Corlett | F41B 11/642 124/56 |
| 9,067,127 | B2 * | 6/2015 | Clark | A63F 9/0291 |
| 9,227,122 | B2 * | 1/2016 | Jakubowski | A63B 67/002 |
| 9,227,148 | B2 * | 1/2016 | Rucker | A63F 7/0668 |
| 10,228,221 | B2 * | 3/2019 | Shurman | F41J 5/24 |
| 2010/0012017 | A1 * | 1/2010 | Miller | A61B 5/015 116/201 |
| 2013/0301034 | A1 * | 11/2013 | Olds | A61N 5/0618 356/51 |
| 2015/0268488 | A1 * | 9/2015 | Lussier | G02F 1/092 359/280 |
| 2015/0296890 | A1 * | 10/2015 | Moloney | A41B 1/08 2/69 |

* cited by examiner

SYSTEM, METHOD AND APPARATUS FOR TOYS AND GAMES FOR WATER GUNS

This application claims priority to and the benefit of U.S. patent application Ser. No. 15/139,922, filed Apr. 27, 2016, entitled "SYSTEM, METHOD AND APPARATUS FOR TOYS AND GAMES FOR WATER GUNS", U.S. Prov. App. No. 62/212,050, filed Aug. 31, 2015, entitled, "Color Changing Target", and U.S. Prov. App. No. 62/266,591, filed Dec. 12, 2015, entitled, "Removable, Wearable Target System", all of which are incorporated herein by reference in their respective entireties.

BACKGROUND

Field of the Disclosure

The present invention relates in general to games and, in particular, to a system, method and apparatus for toys and games for water guns.

Description of the Prior Art

During water gun play, such as a game between teams armed with water pistols, it is sometimes difficult to discern when a player has been successfully "hit" by water. Moreover, there are few existing ways to accurately measure how much and in what locations a player has been "hit". Water gun play could be enhanced with precise, accompanying components that make it more readily discernable how the game is progressing. In addition, it would be beneficial if the components were designed to remain re-usable for many additional games. Accordingly, improvements in water gun toys and games continue to be of interest.

SUMMARY

Embodiments of a system, method and apparatus for toys and games with water guns are disclosed. For example, a toy may include a target having a target magnet and a first color configured to become a second color when the target is activated. The toy also may include a backing comprising a backing magnet configured to be mounted to an interior of a garment. The backing may be magnetically attracted to the target magnet through the garment when the target is on an exterior of the garment. The target may be configured to be retained on the garment only via magnetic force between the target magnet and the backing magnet. The target and the backing may be configured to be readily removed from the garment and have numerous re-uses for future play.

In another embodiment, a toy may include a target on a substrate that is larger than the target. The substrate may be configured to be secured to a garment. The target may include a first color of hydrochromic ink configured to become transparent when moistened by water and reveal an underlying second color. The target may be configured to return to the first color within about 15 minutes after being activated. In addition, the target may be configured to require at least about 5 minutes to return to the first color after being activated. Versions of the target may include a maximum dimension of not greater than about ⅝-inch. In addition, an example of the substrate is not secured to the garment with an adhesive.

An embodiment of a method of playing a game may include providing targets. Each target may have a target magnet and a first color configured to become a second color when the target is activated. The method may include securing the targets to exteriors of garments of users with respective backing magnets on interiors of the garments, such that the targets are retained on the garments only via magnetic force between the target magnets and the backing magnets. The garments may be located between respective ones of the target magnets and the backing magnets. In addition, the method may include shooting water guns at the targets.

So that the manner in which the features and advantages of the embodiments are attained and can be understood in more detail, a more particular description may be had by reference to the embodiments that are illustrated in the appended drawings. However, the drawings illustrate only some embodiments and therefore are not to be considered limiting in scope as there may be other equally effective embodiments.

BRIEF DESCRIPTION OF THE DRAWINGS

The use of the same reference symbols in different drawings indicates similar or identical items.

DETAILED DESCRIPTION

Figure 1A:
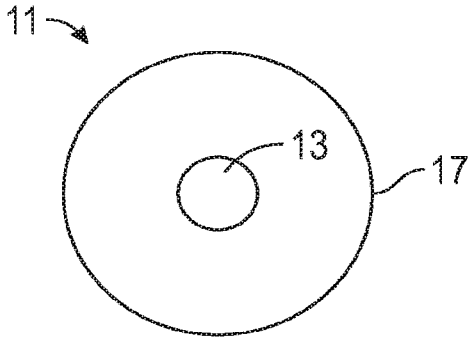
FIGS. 1A-1D depict front views of embodiments of a toy showing, in FIGS. 1A and 1C, the toys in their nominal state and, in FIGS. 1B and 1D, the toys after coming in contact with water.
Figure 1B:
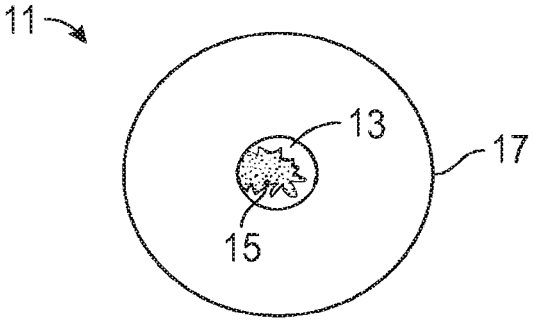
Figure 1C:
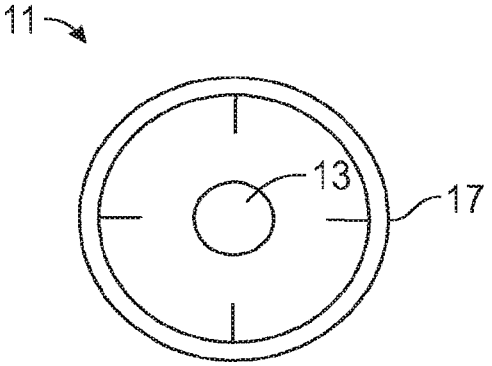

Embodiments of a system, method and apparatus for toys and games with water guns are disclosed. For example, FIGS. 1A-1D depicts embodiments of a toy 11 comprising a target 13. In some versions, the target 13 may have a first color (FIGS. 1A and 1C). Embodiments of the first color may be configured to become a second color 15 (FIGS. 1B and 1D) when the target 13 is actuated or activated. The color change feature may be enabled through the use of a specialized ink or dye, such as hydrochromic ink. In some versions, the target 13 may be activated by water, such as from a water gun. The target 13 may be configured to become transparent when moistened by water and reveal the second color 15.

In addition, examples of the target 13 may be mounted to a substrate 17, such as foam. The target 13 itself may comprise many forms. For example, the target 13 can be printed on a felt material that is mounted to substrate 17. Together, the target 13 and substrate 17 may form a flexible, compliant and comfortable structure when worn by a user.

As the water on target 13 evaporates, the target 13 will change in color back to the first color. The duration of the color change of the target 13 back to the first color may be carefully calibrated to enhance game play. For example, depending on saturation level, atmospheric humidity and other variables, the target 13 may be configured to return to the first color within about 20 minutes after being activated to the second color 15. In other versions, the target 13 may return to the first color within about 19 minutes, such as within about 18 minutes, within about 17 minutes, within about 16 minutes, within about 15 minutes, within about 14 minutes, within about 13 minutes, within about 12 minutes, within about 11 minutes, within about 10 minutes, within about 9 minutes, within about 8 minutes, within about 7 minutes, within about 6 minutes, within about 5 minutes, or even within about 4 minutes. In other versions, the return color change can be in a range between any of these values.

Other examples of the target 13 may be configured to require at least about 1 minute of time to return to the first color after being activated to the second color. In some versions, the target 13 may require at least about 2 minutes, such as at least about 3 minutes, at least about 4 minutes, at least about 5 minutes, at least about 6 minutes, at least about 7 minutes, at least about 8 minutes, at least about 9 minutes, at least about 10 minutes, at least about 11 minutes, or even at least about 12 minutes of time prior to returning to the first color. In other versions, the return color change can be in a range between any of these values.

Examples of the toy 11 may include providing the target 13 with a limited size. For example, the target 13 may include a maximum dimension. In versions of the target 13 that comprise circular shapes, the maximum dimension may comprise the diameter. Examples of the maximum dimension can be not greater than about 1 inch, such as not greater than about ¾-inch, not greater than about ⅝-inch, or even not greater than about ½-inch. Such limited sizing of target 13 significantly enhances the difficulty of scoring hits, the accuracy required of users, and the quality of the game.

Figure 2:
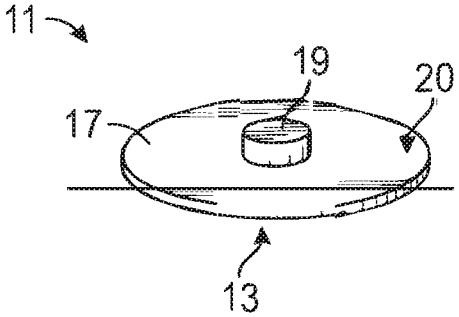
FIG. 2 is a back isometric view of an embodiment of a toy with a target.

Some embodiments of the target 13 may further include a target magnet 19 (FIG. 2). In an example, the target 13 may include the substrate 17 which may have a rear surface 20. The target magnet 19 may be located on and protrude rearward from at least adjacent to the rear surface 20. Versions of the toy 11 may provide that the target 13 be mounted to the front surface of the substrate 17. The target magnet 19 may be attached to the substrate 17 on a side opposite to the target 13. In other versions of the toy 11, the substrate 17 may be larger than the target 13, and the target 13 may be larger than the target magnet 19.

Versions of the target magnet 19 may be secured to the substrate 17 in many ways. For example, a cover, such as a thin layer of polymer-based fabric 22, may be bonded to the substrate to capture the target magnet 19 therebetween. The construction of the various components of the toy 11 again may emphasize a flexible, compliant and comfortable structure when worn by a user.

Figure 3:
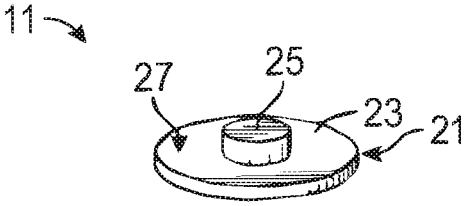
FIG. 3 is a front isometric view of an embodiment of a backing for the toy.

Some versions of the toy 11 may include a backing 21 (FIG. 3). In some examples, the backing 21 may be configured with a substrate 23. Embodiments of the backing 21 may further include a backing magnet 25. The backing 21 may include a front surface 27, and the backing magnet 25 may be located on and protrude forward from the front surface 27. As described herein for other components, the construction of the backing 21 may include flexible, compliant and comfortable materials when worn by a user. In some examples, backing 21 may be constructed in a same or similar manner as the target 13, substrate 17 and target magnet 19.

Figure 4:
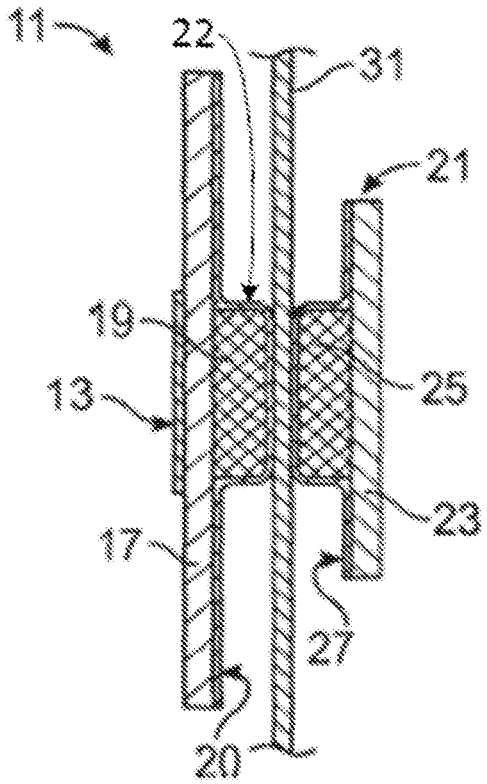
FIG. 4 is a sectional side view of an embodiment of the toy, including the target and backing of FIGS. 2 and 3, with the fabric of a garment therebetween.

Embodiments of the backing magnet 25 may be configured to be mounted to an interior of a garment 31 (FIG. 4). The backing magnet 25 can be magnetically attracted to the target magnet 19 through the garment 31, even when the target 13 is on an exterior of the garment 31. In some versions, the target 13 is configured to be retained on the garment 31 only via magnetic force between the target magnet 19 and the backing magnet 25. In addition, the toy 11, target 13 and the backing 21 may be configured to be readily removed from the garment 31 and have numerous re-uses for future play. In one example, the only location for indicia of a source of the toy 11 (e.g., a trademark, such as a logo), is the back surface of the backing 21, opposite the backing magnet 25. In such an example, the logo may not be located anywhere on the target 13, its substrate 17, nor on the front surface 27 of backing 21.

In some versions of the toy 11, the various components may be different sizes. For example, the backing 21 may be larger than the target 13. In another example, the backing 21 may be larger than the target magnet 19 and the backing magnet 25, as shown. The components also may comprise various shapes. In an example, the toy 11 may include providing each of the target 13, the substrate 17, the target magnet 19, the backing 21 and the backing magnet 25 in circular shapes. Embodiments of the larger sizes of substrates 17 and 23 (relative to the magnets 19, 25) help provide leverage to facilitate easier removal of the toy 11 (e.g., target 13 and backing 21) from a garment 31. In addition, the sizes of the substrates 17, 23 help reduce the risk of loss of components of the toy 11, as they can be more readily identified when misplaced.

Embodiments of the toy 11 may include providing the target magnet 19 and the backing magnet 25 as certain types of magnets. For example, each of the target magnet 19 and the backing magnet 25 could be Neodymium (NdFeB) rare earth magnets. In a particular example, the target magnet 19 and the backing magnet 25 may each comprise N35, cylindrical disk magnets.

In another embodiment, the target magnet 19 and the backing magnet 25 each may have a selected thickness. For example, the thickness can be at least about ⅛-inch, such as about 3/16-inch. Alternatively, the thickness of magnets 19, 25 can be not greater than about ¼-inch. The magnets 19, 25 also may include a selected diameter. For example, the diameter can be at least about ¼-inch, such as about ⅜-inch. Alternatively, the diameter of the magnets 19, 25 could be not greater than about ½-inch. Embodiments of the target magnet 19 and the backing magnet 25 may be identical, or they may be different.

Versions of the toy 11 also may include providing the magnets 19, 25 with a selected strength. For example, upon contact, each of the target magnet 19 and the backing magnet 25 may include a selected magnetic pull force. Versions of the magnetic pull force can be at least about 1 pound, such as at least about 2 pounds, at least about 3 pounds, at least about 4 pounds, or even at least about 5 pounds. In other versions, the magnetic pull force can be not greater than about 8 pounds, such as not greater than about 7.5 pounds, not greater than about 7 pounds, not greater than about 6.5 pounds, or even not greater than about 6 pounds. Other versions of the magnetic pull strength can be in a range between any of these values. Again, embodiments of the target magnet 19 and the backing magnet 25 may be identical, or they may be different.

Figure 5:
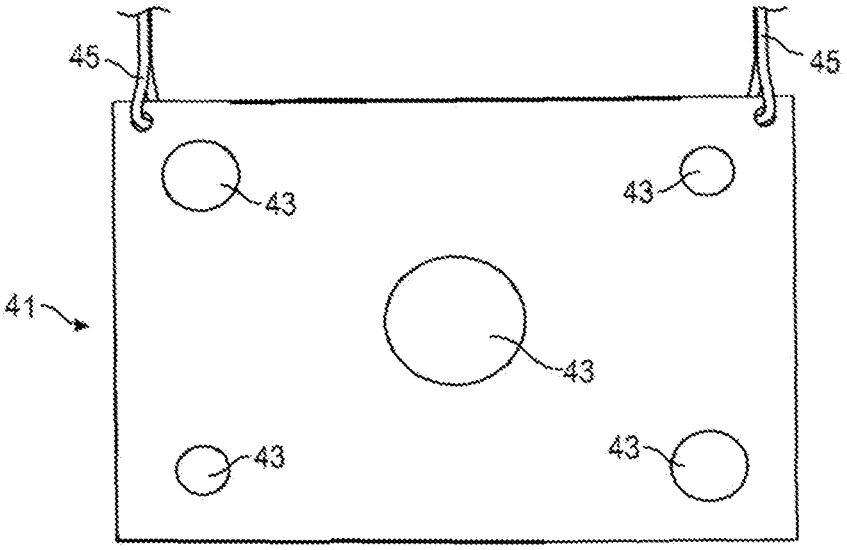
FIG. 5 is a front view of an embodiment of an auxiliary component for a toy or game.

Referring now to FIG. 5, the toy 21 may further comprise other components. For example, toy 11 may include an article 41 having at least one article target 43. Such articles 41 may include various objects, such as flags, banners, etc., and may be various shapes and sizes. Like target 13, article target 43 may be configured to change colors, such as with hydrochromic ink. Some versions of article target 43 may be configured to become transparent when moistened by water and reveal a different, underlying second color. Article target 43 may be configured to return to the first color after the water evaporates.

In the version illustrated, article 41 has five article targets 43. The article targets 43 may comprise the same shape or different shapes. The article targets 43 also may include a variety of shapes, such as circular shapes. In addition, the article targets 43 may comprise a same size or different sizes.

In an example, the article targets may include diameters in a range of about ¾-inch to about 1.5 inches. Embodiments of the article 41 may be mountable to an object, or wearable by a user. Article 41 can include fastening means 45 (e.g., strings, fasteners, etc.), which may be configured to secure the article 41 to a user or object. In one version, the article 41 and the fastening means 45 do not comprise magnets.

In the embodiment of FIG. 5, a largest size of the article targets 43 may be located in or near a center of the article 41. A medium size of the article targets 43 may be located adjacent a perimeter of the article 41, such as the upper left and lower right corners. In addition, a smallest size of the article targets 43 may be located adjacent another portion of the perimeter of the article 43, such as the lower left and upper right corners, in the illustrated version. Such embodiments enable the play of many different types of games.

Figure 1D:
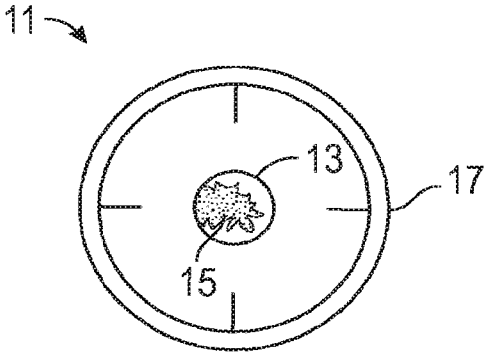

Still other embodiments of the toy 11 (FIGS. 1A and 1C) may include positioning the target 13 on the substrate 17, which can be larger than the target 13. The substrate 17 may be configured to be secured to the garment 31 (FIG. 4). The target 13 may include a first color of hydrochromic ink configured to become transparent when moistened by water and reveal an underlying second color 15 (FIGS. 1B and 1D). The target 13 may be configured to return to the first color within about 10 minutes after being activated. In addition, the target 13 may be configured to require at least about 2 minutes to return to the first color after being activated. In one version, the target 13 may comprise a maximum dimension of not greater than about ⅝-inch.

Some versions of the toy 11 may include providing the target 13 to be retained on the garment 31 via one or more of magnetism, mechanical interlock, a fastener, hook and loop attachments. Optionally, the substrate 17 may not be secured to the garment 31 with an adhesive.

Alternate embodiments of the toy 11 may further include at least one other component that may be configured to couple the target 13 to the garment 31. For example, the other component could be the backing 21. Versions of the toy 13 may further include the article 41 having at least one article target 43. The at least one article target 43 may comprise hydrochromic ink configured to become transparent when moistened by water and reveal a different color.

Embodiments of a method of playing a game also are disclosed. In an example, the method may comprise providing targets 13. Each target 13 may include a target magnet 19 and a first color configured to become a second color 15 when the target is activated. The method may include securing the targets 13 to exteriors of garments 31 of users with respective backing magnets 25 on interiors of the garments 31. In some versions, the targets 13 may be retained on the garments 31 only via magnetic force between the target magnets 19 and the backing magnets 25, such that the garments 31 are located between respective ones of the target magnets 19 and the backing magnets 25. In addition, the method may include shooting water guns at the targets 13. In some embodiments, the method may comprise scoring a 'hit' only when 100% of the second color of at least one of the targets 13 is revealed. Note that in FIGS. 1B and 1D, the target 13 is depicted as revealing less than 100% of the second color 15. In those images, if target 13 revealed 100% of the second color 15 the entire circular target 13 would be darkened.

Versions of multiple wearable, removable, and adjustable targets can be placed on different parts of the body, with various garments 31, in different numbers, and to change color when wet to indicate how many and which targets have been "hit".

A system of targets may be applied to different parts of the body, in select locations. The targets can include hydrochromic ink printed on fabric on the exterior surface, and a material that adheres the target to the body. The magnets may be sewn or glued into fabric so they are enclosed. The magnets can be worn with one magnet on each side of a wearable fabric (such as a shirt or pants), and are removable and can be placed in multiple locations on the body, such as with a wearable article, like but not limited to, a vest, shirt, pants, socks or wearable straps.

The toy may be used in a game where the color changing on contact with liquid is integral to scoring points in competition. The targets may be worn on the body and/or attached to inanimate objects.

In another example, the toy may comprise a kit having a set of the targets, one or more of the articles, and game instructions. The kit may include a bag or other container for housing the various components. The kit also may include one or more water dispensing devices, such as one or more water weapons, like water pistols.

Other versions may include one or more of the following embodiments:

Embodiment 1. A toy, comprising:

a target having a target magnet and a first color configured to become a second color when the target is activated;

a backing comprising a backing magnet configured to be mounted to an interior of a garment and magnetically attracted to the target magnet through the garment when the target is on an exterior of the garment, such that the target is configured to be retained on the garment only via magnetic force between the target magnet and the backing magnet; and the target and the backing are configured to be readily removed from the garment and have numerous re-uses for future play.

Embodiment 2. The toy of any of these embodiments, wherein the target has a rear surface, and the target magnet protrudes rearward from at least adjacent to the rear surface.

Embodiment 3. The toy of any of these embodiments, wherein the backing has a front surface and the backing magnet protrudes forward from the front surface.

Embodiment 4. The toy of any of these embodiments, wherein the target comprises a maximum dimension of not greater than about ⅝-inch.

Embodiment 5. The toy of any of these embodiments, wherein the backing is larger than the target, the target magnet and the backing magnet.

Embodiment 6. The toy of any of these embodiments, wherein the target is mounted to a substrate, the target magnet is attached to the substrate on a side opposite to the target.

Embodiment 7. The toy of any of these embodiments, wherein the substrate is larger than the target, the target is larger than the target magnet.

Embodiment 8. The toy of any of these embodiments, wherein each of the target, the substrate, the target magnet, the backing and the backing magnet comprise a circular shape.

Embodiment 9. The toy of any of these embodiments, wherein the target is configured to return to the first color within about 15 minutes after being activated, and the target is configured to require at least about 5 minutes to return to the first color after being activated.

Embodiment 10. The toy of any of these embodiments, wherein the target magnet and the backing magnet each comprise Neodymium (NdFeB) rare earth magnets.

Embodiment 11. The toy of any of these embodiments, wherein the target magnet and the backing magnet each comprise N35, cylindrical disk magnets.

Embodiment 12. The toy of any of these embodiments, wherein the target magnet and the backing magnet each comprise a thickness of at least about ⅛-inch and not greater than about ¼-inch.

Embodiment 13. The toy of any of these embodiments, wherein the target magnet and the backing magnet each comprise a diameter of at least about ¼-inch and not greater than about ½-inch.

Embodiment 14. The toy of any of these embodiments, wherein, upon contact, each of the target magnet and the backing magnet comprises a magnetic pull force in a range of about 4 pounds to about 8 pounds.

Embodiment 15. The toy of any of these embodiments, wherein the target magnet and the backing magnet are identical.

Embodiment 16. The toy of any of these embodiments, further comprising an article having at least one article target.

Embodiment 17. The toy of any of these embodiments, wherein the at least one article target comprises hydrochromic ink configured to become transparent when moistened by water and reveal a different color.

Embodiment 18. The toy of any of these embodiments, wherein the at least one article target comprises circular shapes of different sizes, and each circular shape has a diameter in a range of about ¾-inch to about 1.5 inches.

Embodiment 19. The toy of any of these embodiments, wherein the article is wearable and comprises fastening means configured to secure the article to a user or an object, and the article and the fastening means do not comprise magnets.

Embodiment 20. The toy of any of these embodiments, wherein a largest size of the at least one article target is located in a center of the article, a medium size of the at least one article target is located adjacent a perimeter of the article, and a smallest size of the at least one article target is located adjacent another portion of the perimeter of the article.

Embodiment 21. The toy of any of these embodiments, wherein the target comprises hydrochromic ink configured to become transparent when moistened by water and reveal the second color.

Embodiment 22. A toy, comprising:

a target on a substrate that is larger than the target, the substrate is configured to be secured to a garment, the target comprises a first color of hydrochromic ink configured to become transparent when moistened by water and reveal an underlying second color, the target is configured to return to the first color within about 15 minutes after being activated, and the target is configured to require at least about 5 minutes to return to the first color after being activated, and the target comprises a maximum dimension of not greater than about ⅝-inch; and the substrate is not secured to the garment with an adhesive.

Embodiment 23. The toy of any of these embodiments, wherein the target is configured to be retained to the garment via one or more of magnetism, mechanical interlock, a fastener, hook and loop attachments.

Embodiment 24. The toy of any of these embodiments, further comprising a component configured to couple the target to the garment.

Embodiment 25. The toy of any of these embodiments, further comprising an article having at least one article target, and the at least one article target comprises hydrochromic ink configured to become transparent when moistened by water and reveal a different color.

Embodiment 26. A method of playing a game, comprising:

(a) providing targets, each target having a target magnet and a first color configured to become a second color when the target is activated;

(b) securing the targets to exteriors of garments of users with respective backing magnets on interiors of the garments, such that the targets are retained on the garments only via magnetic force between the target magnets and the backing magnets, such that the garments are located between respective ones of the target magnets and the backing magnets; and then (c) shooting water weapons at the targets.

Embodiment 27. The method of any of these embodiments, wherein step (c) comprises scoring a 'hit' on one of the targets only when 100% of the second color of said one of the targets is revealed.

Embodiment 28. A toy, comprising:

a target having a target magnet and a first color configured to become a second color when the target is activated; and a backing comprising a backing magnet configured to be mounted to a garment and magnetically attracted to the target magnet when the target is on an exterior of the garment, such that the target is configured to be retained on the garment only via magnetic force between the target magnet and the backing magnet.

Embodiment 29. The toy of any of these embodiments, wherein the backing is mounted to the garment.

Embodiment 30. The toy of any of these embodiments, wherein the backing is located inside the garment.

Embodiment 31. The toy of any of these embodiments, wherein the backing is sewn into the garment, such that the backing permanently remains with the garment.

Embodiment 32. The toy of any of these embodiments, wherein the target and the backing are configured to be readily removed from the garment and have numerous re-uses for future play.

This written description uses examples to disclose the embodiments, including the best mode, and also to enable those of ordinary skill in the art to make and use the invention. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Note that not all of the activities described above in the general description or the examples are required, that a portion of a specific activity may not be required, and that one or more further activities may be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

What is claimed is:

1. A toy, comprising:

a target piece configured to position on an exterior surface of a garment, the target piece including a conformable target substrate, a target, and a target magnet, wherein the conformable target substrate comprises a first conformable target substrate surface including the target and a second conformable target substrate surface that is opposite the first conformable target substrate surface and that is fixedly attached to the target magnet, wherein the target is configured to transition from a non-activated state to an activated state when the target receives a stimulus; and a backing piece configured to position on an interior surface of the garment, the backing piece including a backing magnet, wherein when the target piece is positioned on the exterior surface of the garment and the backing piece is positioned on the interior surface of the garment, the backing magnet is configured to apply an attraction magnetic force through the garment and to the target magnet to secure the target piece to the exterior surface of the garment.

2. The toy of claim 1, wherein the conformable target substrate comprises a foam.

3. The toy of claim 1, wherein when the target transitions from the non-activated state to the activated state, the target transitions from a non-transparent state to a transparent state.

4. The toy of claim 3, wherein when the target is in the non-transparent state, the target comprises a first color, and wherein when the target transitions to the transparent state, the target reveals a second color that is different from the first color.

5. The toy of claim 3, wherein when the target is in the non-transparent state, the target covers an image, and wherein when the target transitions to the transparent state, the target reveals the image.

6. The toy of claim 3, wherein the target comprises hydrochromic ink that causes the target to transition from the non-transparent state to the transparent state when the target receives the stimulus.

7. The toy of claim 1, wherein the target is configured to transition from the activated state to the non-activated state within a predetermine time after the target transitions from the non-activated state to the activated state.

8. The toy of claim 1, wherein the stimulus comprises water.

9. A toy, comprising:

a target piece configured to position on an exterior surface of a garment, the target piece including a conformable target substrate, a target, a target magnet, and a cover, wherein the conformable target substrate comprises a first conformable target substrate surface including the target and a second conformable target substrate surface that is opposite the first conformable target substrate surface, wherein the cover is disposed over the target magnet and fixedly attaches the target magnet to the second conformable target substrate surface, and wherein the target is configured to transition from a non-activated state to an activated state when the target receives a stimulus; and a backing piece configured to position on an interior surface of the garment, the backing piece including a backing magnet, wherein when the target piece is positioned on the exterior surface of the garment and the backing piece is positioned on the interior surface of the garment, the backing magnet is configured to apply an attraction magnetic force through the garment and to the target magnet to secure the target piece to the exterior surface of the garment.

10. The toy of claim 9, wherein the cover comprises a polymeric-based fabric that is bonded to the second conformable target substrate surface.

11. The toy of claim 9, wherein the conformable target substrate is larger than the target, and wherein the target is larger than the target magnet.

12. The toy of claim 9, wherein the target magnet and the backing magnet each comprise at least one of Neodymium (NdFeB) rare earth magnets or N35, cylindrical disk magnets.

13. The toy of claim 9, wherein target magnet and the backing magnet each comprise at least one of a thickness between about ⅛-inch and about ¼-inch or a diameter between about ¼-inch and about ½-inch.

14. The toy of claim 9, wherein the target comprises a maximum dimension that is not greater than about ⅝-inch.

15. A toy, comprising:

a target piece configured to position on an exterior surface of a garment, the target piece including a conformable target substrate, a target, and a target magnet, wherein the conformable target substrate comprises a first conformable target substrate surface including the target and a second conformable target substrate surface that is opposite the first conformable target substrate surface and that is fixedly attached to the target magnet, wherein the target is configured to transition from a non-activated state to an activated state when the target receives a stimulus; and a backing piece configured to position on an interior surface of the garment, the backing piece including a backing magnet, wherein when the target piece is positioned on the exterior surface of the garment and the backing piece is positioned on the interior surface of the garment, the backing magnet is configured to apply an attraction magnetic force through the garment and to the target magnet to secure the target piece to the exterior surface of the garment, and wherein the backing piece is integrated into the garment.

16. The toy of claim 15, wherein the backing piece is sewn into the garment.

17. The toy of claim 15, wherein when the backing magnet applies the attraction magnetic force through the garment and to the target magnet, the attraction magnetic force applied from the backing magnet comprises a range between about 4 pounds and about 8 pounds.

18. The toy of claim 15, wherein the target magnet and the backing magnet are identical magnets.

19. The toy of claim 15, wherein target magnet and the backing magnet each comprise at least one of a thickness between about ⅛-inch and about ¼-inch or a diameter between about ¼-inch and about ½-inch.

20. The toy of claim 15, wherein the conformable target substrate comprises a foam.

* * * * *